US009716343B2

(12) United States Patent
Wess et al.

(10) Patent No.: US 9,716,343 B2
(45) Date of Patent: Jul. 25, 2017

(54) ARRANGEMENT WITH MODULAR PARTS AND AN ADJUSTABLE CODING

(71) Applicant: SELECTRON SYSTEMS AG, Lyss (CH)

(72) Inventors: Robert Wess, Kerzers (CH); Werner Hunziker, Oberdorf (CH)

(73) Assignee: SELECTRON SYSTEMS AG (CH)

( * ) Notice: Subject to any disclaimer, the term of this patent is extended or adjusted under 35 U.S.C. 154(b) by 33 days.

(21) Appl. No.: 14/830,792

(22) Filed: Aug. 20, 2015

(65) Prior Publication Data

US 2016/0064863 A1 Mar. 3, 2016

(30) Foreign Application Priority Data

Aug. 27, 2014 (EP) ..... 14182489

(51) Int. Cl.
*H01R 13/642* (2006.01)
*H01R 13/645* (2006.01)

(52) U.S. Cl.
CPC ..... *H01R 13/642* (2013.01); *H01R 13/645* (2013.01)

(58) Field of Classification Search
CPC .... H01R 13/64; H01R 13/641; H01R 13/642; H01R 13/645; H01R 13/6453
See application file for complete search history.

(56) References Cited

U.S. PATENT DOCUMENTS 3,611,272 A * 10/1971 Fairbairn ..... H01R 13/6453 439/681
4,277,126 A * 7/1981 Lincoln ..... H01R 13/6453 439/681

(Continued)

FOREIGN PATENT DOCUMENTS

DE 25 34 775 A1 2/1977
DE 43 43 024 A1 6/1994

(Continued)

OTHER PUBLICATIONS

European Search Report dated Feb. 6, 2015 issued in corresponding European patent application No. 14 18 2489.

*Primary Examiner* — James Harvey
*Assistant Examiner* — Oscar C Jimenez
(74) *Attorney, Agent, or Firm* — Ostrolenk Faber LLP

(57) ABSTRACT

The arrangement includes at least one modular part of a first type (60), at least one modular part of a second type (60'), an adjustable coding (10, 10'), which has coding settings, which allow or prevent a joining together of the modular parts, and a holding appliance (62-64, 62'-64') for holding one modular part on the other modular part when these are joined together. Coding elements (10, 10') are provided, which in each case are received in a receiving space (51, 51') formed in the modular part of the first or second type (50, 50', 60, 60') and which in each case have a projection (31, 31') projecting out of the receiving space. The respective coding element is disposed so as to be movable to and fro in order to assume at least two coding positions, which can be selected so that a) for joining together of the modular parts a respective projection of a coding element is disposed offset in the direction of movement with respect to the projection of an opposing coding element, and b) for prevention of a joining together of the modular parts at least one projection of a coding element abuts the projection of an opposing coding element.

20 Claims, 5 Drawing Sheets

(56) References Cited

U.S. PATENT DOCUMENTS

| | | | | | |
|---|---|---|---|---|---|
| 4,595,250 | A | | 6/1986 | Joly et al. | |
| 4,778,411 | A | * | 10/1988 | Rudy, Jr. | H01R 13/642 439/358 |
| 5,273,462 | A | * | 12/1993 | Huser | H01R 13/645 439/341 |
| 5,441,426 | A | | 8/1995 | Boulais | |
| 6,142,592 | A | | 11/2000 | Grittke et al. | |
| 6,196,881 | B1 | | 3/2001 | Abert et al. | |
| 6,485,336 | B1 | * | 11/2002 | Zebermann | H05K 7/1455 439/677 |
| 9,225,117 | B2 | * | 12/2015 | Jacobsson | H01R 13/514 |
| 2002/0146931 | A1 | | 10/2002 | Richmond et al. | |

FOREIGN PATENT DOCUMENTS

| | | |
|---|---|---|
| DE | 195 00 156 A1 | 7/1995 |
| DE | 199 64 150 A1 | 9/2000 |
| WO | WO 91/10271 A1 | 7/1991 |

* cited by examiner

ARRANGEMENT WITH MODULAR PARTS AND AN ADJUSTABLE CODING

FIELD OF THE INVENTION

The invention relates to an arrangement with modular parts and an adjustable coding, which has coding settings which allow or prevent a joining together of the modular parts.

BACKGROUND OF THE INVENTION

When handling a plurality of modular parts it is often necessary to ensure that modular parts are not connected to one another in a prohibited manner. If for example electrical connections are to be provided between the modular parts, an incorrect joining together can cause defective operation of the modular part or even destruction thereof. The modular parts can be customized by the use of a coding, so that joining together in a prohibited manner is prevented.

It is known from U.S. Pat. No. 4,595,250 to provide a coding in the form of rotatable elements which have projecting fingers on one modular part and corresponding openings on the other modular part. This type of coding makes the structure relatively complicated, since it has to be constructed differently for the two modular parts and special provisions must be made which on the one hand enable the elements to be rotated if required, but which on the other hand prevent the elements from being moved inadvertently out of a defined rotated position.

It is known from U.S. Pat. No. 6,142,592 to provide a coding in the form of recesses on the modular parts into which coding pins can be inserted. This type of coding has the disadvantage that the coding pins are formed as separate parts and therefore can be lost in some circumstances. If not all the openings are provided with a coding pin, there is a danger that the coding is no longer unambiguous and thus it is possible to join modular parts together in a prohibited manner.

It is known from U.S. Pat. No. 6,196,881 to provide a coding in the form of recesses on one modular part and movable sliders with pins on the other modular part. If the coding setting allows the joining together of the modular parts, the pins engage in the recesses.

This type of coding has the disadvantage of a limited adjustability, since the recesses on one modular part have to be provided already at the time of production, so that the positions thereof cannot be changed at a later stage.

It is known from DE 25 34 775 A1 to provide a coding in the form of projecting coding elements which consist of insertable lugs on one modular part and teeth which can be broken out on the other modular part. This type of coding also has the disadvantage of limited adjustability, since breaking out of a tooth can no longer be reversed.

SUMMARY OF THE INVENTION

It is an object of the present invention to provide an arrangement which has modular parts and a coding with a simpler structure and improved adjustability.

This object is achieved by an arrangement, which comprises a coding with coding elements, which can be moved to and fro. Each coding element is received in a receiving space and comprises a projection, which projects out of the receiving space. Coding positions can be set in which either a joining together of the modular parts is possible, wherein a respective projection of a coding element is disposed in the direction of movement offset with respect to the projection of an opposing coding element, or a joining together of the modular parts is prevented, wherein at least one projection of a coding element abuts the projection of an opposing coding element.

As a result the adjustability is improved and the structure is simplified.

Preferably, the respective projection of a coding element is configured so that it is accessible for manual actuation. Thus the coding element can be moved without the need to use an additional tool.

BRIEF DESCRIPTION OF THE DRAWINGS

Further specific design features and the advantages thereof are disclosed by the following description and drawings of an embodiment, in which.

DETAILED DESCRIPTION OF THE PREFERRED EMBODIMENTS

Figure 1:
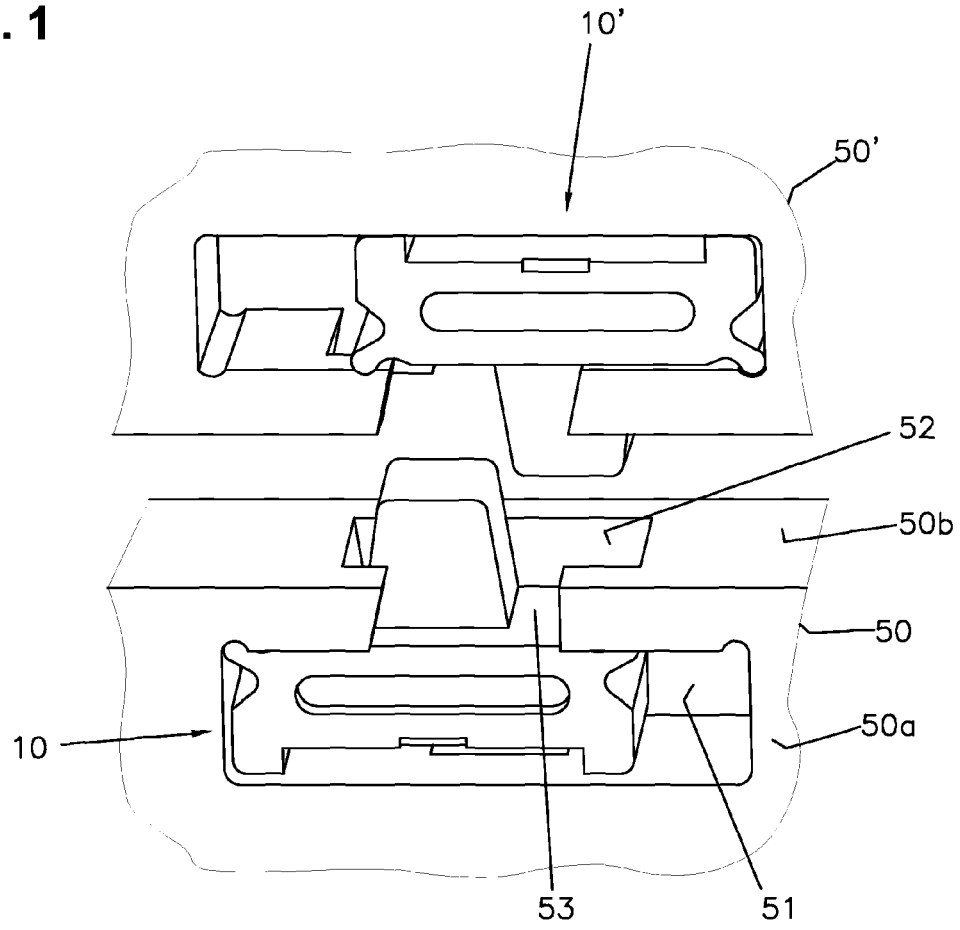
FIG. 1 shows a perspective detail view of two modular parts with coding elements.
Figure 11:
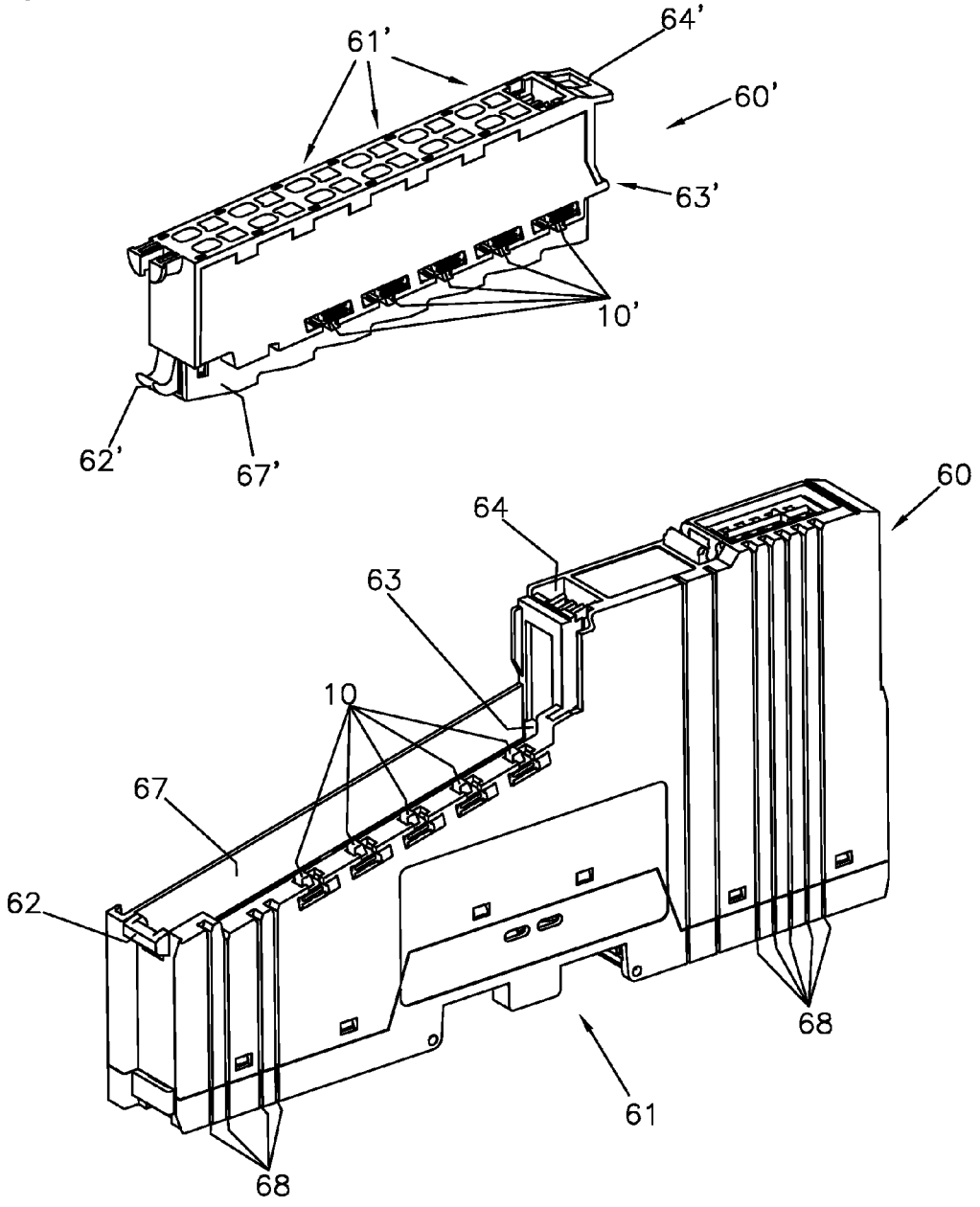
FIG. 11 shows an arrangement with modular parts and a plurality of coding locations according to FIG. 1 in a perspective view.

FIG. 1 shows a coding location with coding elements 10, 10' disposed on modular parts 50, 50' which can be joined together, for example on a housing or a connector with terminals (cf. FIG. 11). A respective coding element 10, 10' is movable to and fro, so that it can assume two coding positions. This drawing shows the situation where the selected coding position allows the modular parts 50, 50' to be joined together.

The two coding elements 10 and 10' as well as the arrangement thereof on the respective modular parts 50, 50' are constructed in the same way here. The coding element 10 and the arrangement thereof on the modular part 50 are explained more precisely below. The description applies in an analogous manner to the coding element 10'.

Figure 2:
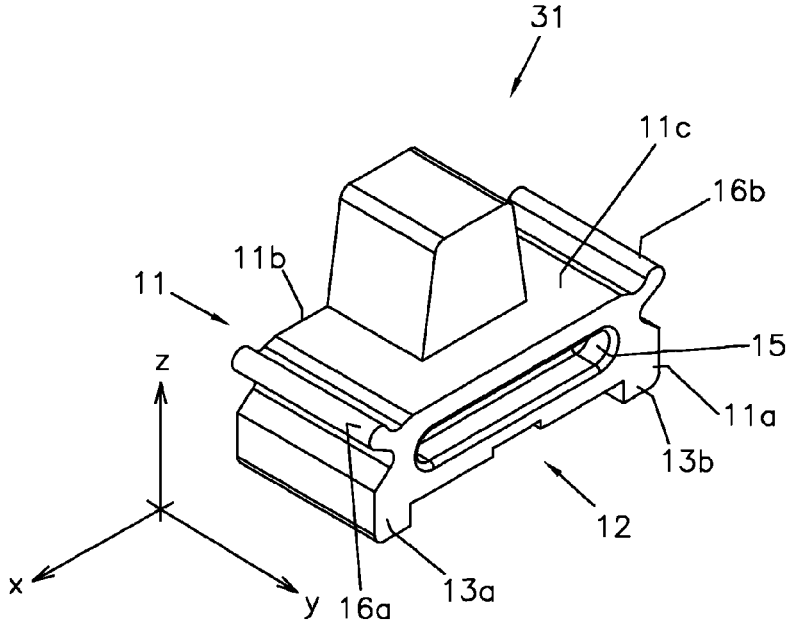
FIG. 2 shows a perspective view of an individual coding element of FIG. 1.
Figure 3:
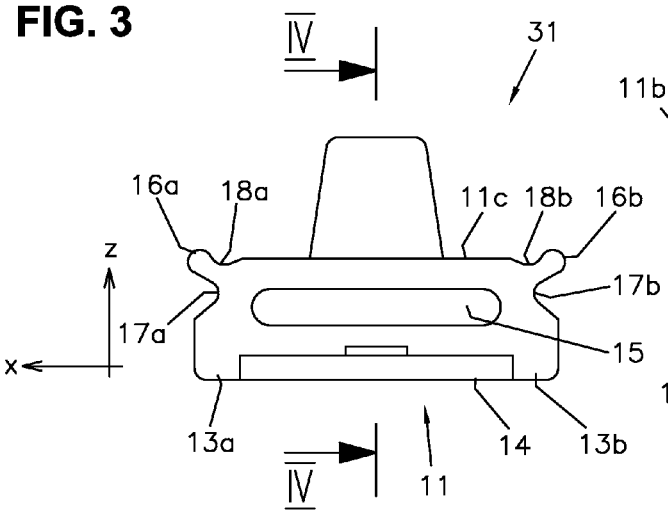
FIG. 3 shows the coding element of FIG. 2 in a front view.
Figure 4:
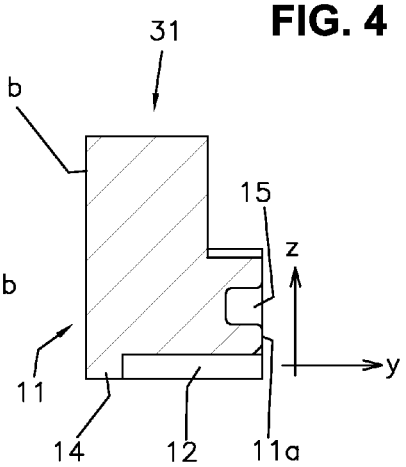
FIG. 4 shows the coding element of FIG. 2 in a sectional side view according to the plane IV-IV indicated in FIG. 3.

An individual coding element 10 is shown in FIGS. 2-4. For the following explanation a coordinates system X, Y, Z is used, wherein the X axis is given by the direction along which the coding element 10 can be moved to and fro, and the Y and Z axes which are disposed transversely with respect thereto run along the width and height respectively of the coding element 10.

The coding element 10 has a basic body 11 and a projection 31 set thereon. The basic body 11 is provided on the underneath face with a recess 12 which extends from the front face 11*a* into the interior. As a result a foot part 13*a*, 13*b* is formed in each case on the left and right side according to FIG. 3 and a guide part 14 which projects downwards (cf. FIG. 4) is formed on the rear face 11*b* of the basic body 11.

A groove 15 is introduced into the front face 11*a* of the basic body 11 above the foot parts 13*a*, 13*b*.

A locking ridge 16*a*, 16*b* which extends in the Y axis is disposed in each case on the left and right side according to FIG. 3 at the upper end of the basic body 11. As shown in particular in FIG. 3, the wall of the basic body 11, which is located adjacent to the respective locking ridge 16*a*, 16*b*, is provided with weakened areas 17*a*, 18*a*, 17*b*, 18*b*, as the wall extends inwards there and thus the wall thickness is reduced. In this way the locking ridges 16*a*, 16*b* are given a resilience which enables them to move downwards in the Z axis, i.e. towards the foot parts 13*a*, 13*b*.

Figure 5:
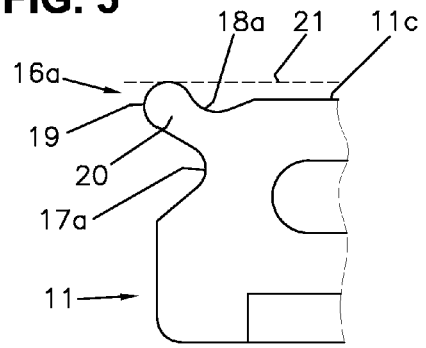
FIG. 5 shows a view of a detail from FIG. 3.

As the detail view in FIG. 5 shows, the locking ridge 16*a* has a round head 19 when viewed in cross-section, said head being connected via a narrowing web 20 to the rest of the basic body 11. The cross-section of the other locking ridge 16*b* is constructed analogously.

In the rest state as shown in FIGS. 3 and 4, the locking ridges 16*a*, 16*b* extend beyond the level which is defined by the upper face 11*c* of the basic body 11 on which the projection 31 is disposed (cf. the broken line 21 in FIG. 5). When a force is applied to the locking ridge 16*a*, 16*b* this level is lowered.

The projection 31 is formed by a part which projects out of the basic body 11 and is disposed offset towards the rear when viewed in the Y axis, so that a distance is provided between the front face 11*a* of the basic body 11 and the projection 31 (cf. FIG. 4). The projection 31 here is disposed flush with the rear face 11*b* of the basic body 11 (cf. FIG. 4) and has a tapered shape when viewed in the Z axis (cf. FIG. 3).

The movable support of the coding element 10 can be seen in FIGS. 1 as well as 6-9. The modular part 50 has a receiving space 51 which extends from the front face 50*a* of the modular part 50 into the interior thereof and is substantially cuboid here. The upper face 50*b* of the modular part 50 disposed transversely with respect to the front face 50*a* has a slot 52, which opens into the receiving space 51 and has an opening 53 at the front face 50*a*. The basic body 11 of the coding element 10 is received in the receiving space 51, whereas the projection 31 projects outwards out of the receiving space 51 through the slot 52. The extent thereof in the X axis is selected so that there is space for two projections 31 adjacent to one another.

Figure 6:
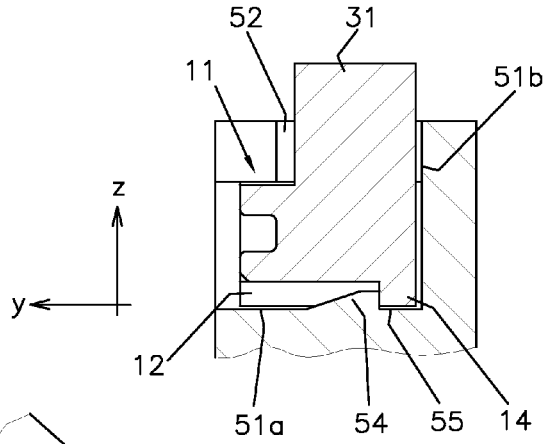
FIG. 6 shows the lower part of the arrangement of FIG. 1 in a sectional side view.
Figure 7:
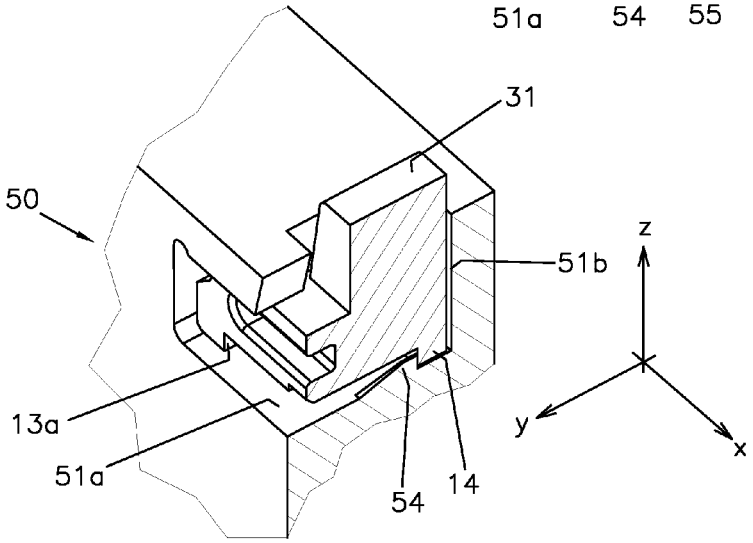
FIG. 7 shows the lower part of the arrangement of FIG. 1 in a sectional perspective side view.
Figure 9:
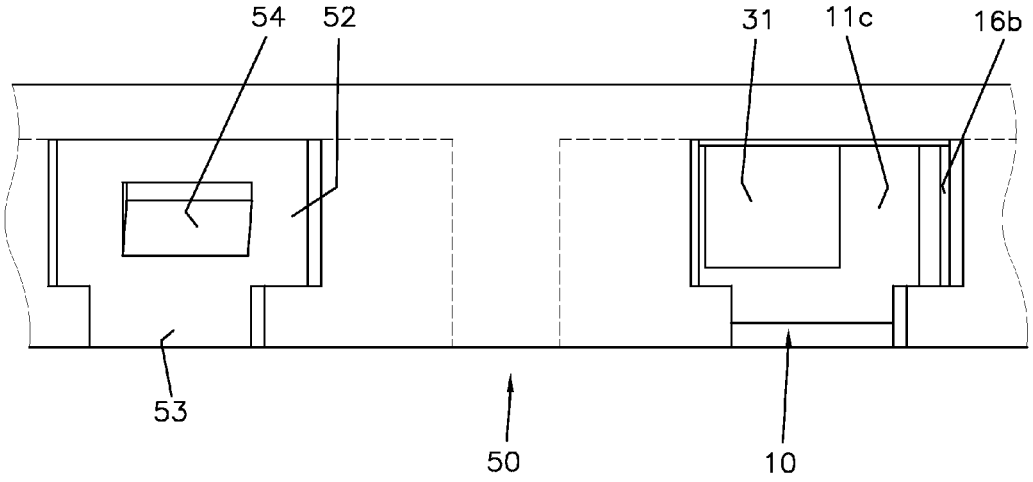
FIG. 9 shows a plan view of the lower part of the arrangement of FIG. 1 with a further coding location, FIGS. 10*a*-10*d* respectively show four different coding settings of the arrangement of FIG. 1 in a sectional side view.

On the base 51*a* of the receiving space 51*a* guide element 54 is disposed which is located inside the recess 12 of the coding element 10 and is spaced apart from the rear face 51*b* of the receiving space 51 (see for example FIG. 9, which shows two coding locations, the left coding location being shown without the coding element 10). As a result a guide groove 55 is defined in which the guide part 14 of the coding element 10 engages (cf. FIG. 6).

Figure 8:
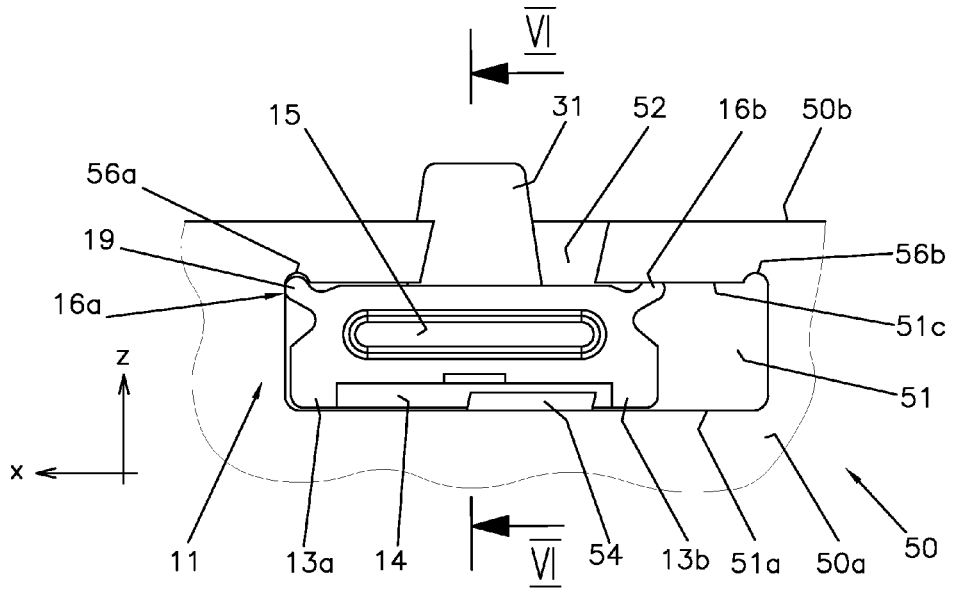
FIG. 8 shows the lower part of the arrangement of FIG. 1 in a front view.

A locking groove 56*a*, 56*b* having an undercut and extending in the Y direction is introduced on each side at the top 51*c* of the receiving space 51 (see FIG. 8). The cross-sectional shape of the locking groove 56*a*, 56*b* is round here and is adapted to the cross-sectional shape of the head of the locking ridge 16*a* or 16*b* respectively.

In the coding position according to FIG. 8 the locking ridge 16*a* engages via its head 19 in the locking groove 56*a*. The other locking ridge 16*b* is located at least partially at the top 51*c* of the receiving space 51 (cf. also the view in FIG. 9). The locking ridge 16*b* is moved downwards out of its rest position, so that due to its resilience it presses against the top 51*c*.

In order to bring the coding element 10 into the other coding position, a force is exerted on the projection 31 and/or groove 15, so that the head 19 of the locking ridge 16*a* is pressed downwards and is pushed out of the locking groove 56*a*. The head 19 now rests on the top 51*c*. The coding element 10 is then moved further until the locking ridge 16*b* engages in the locking groove 56*b*. Thereby, the movement is guided by the elements 14, 54.

The coding element 10 can be manufactured for example in one piece out of plastic or another material. The provision of the opening 53 (cf. FIG. 9) makes it possible to insert the coding element 10 from the outside into the receiving space 51. The guide element 54 is designed in the form of a ramp which rises towards the guide groove 55 (cf. FIG. 6). This shaping makes it easier during the assembly of the coding element 10 to push the guide part 14 over the guide element 54 until it comes into engagement in the guide groove 55.

With a pair of coding elements 10, 10' disposed on modular parts 50, 50' which can be joined together, four different coding positions can be set, such as are illustrated in FIGS. 10*a*-10*d*. In these drawings "0" designates the position in which the coding element 10, 10' is located on the left when viewed in the direction of the projection 31, 31', whilst "1" is the position in which the coding element 10, 10' is located on the right when viewed in the direction of the projection 31, 31'. The letter "A" relates to the coding element 10, and the letter "B" relates to the coding element 10'.

Figure 10A:
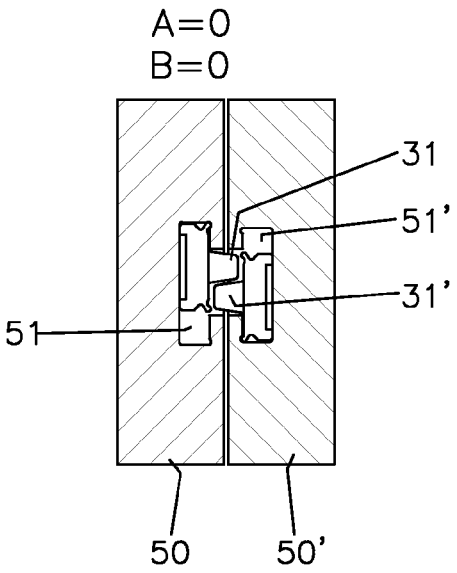
Figure 10B:
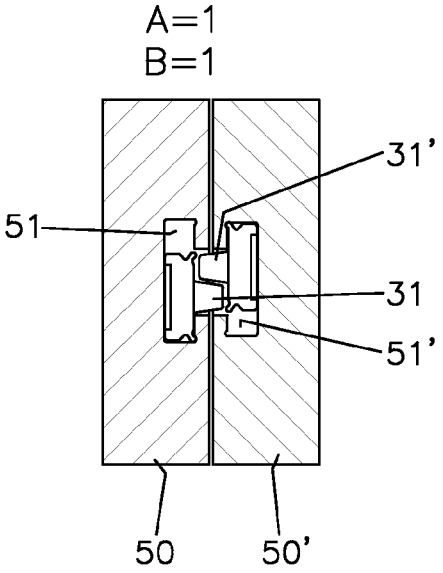
Figure 10C:
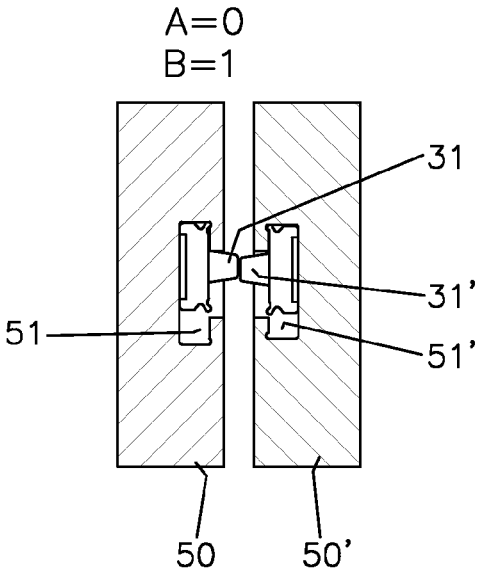
Figure 10D:
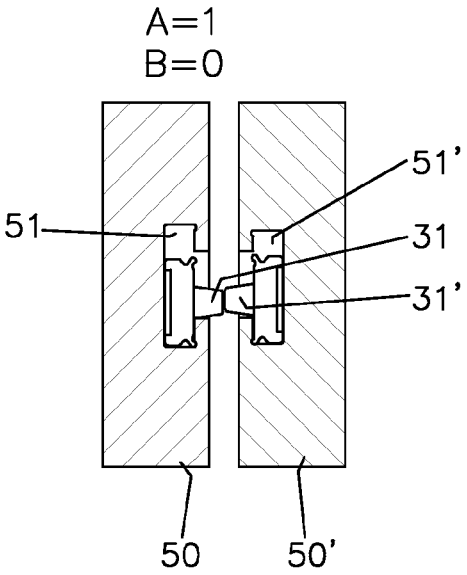

In the situation according to FIGS. 10*a* and 10*b* the two coding elements 10, 10' are located in the same position (i.e. either position 0 or position 1), so that the modular parts 50, 50' could be joined together. The projections 31, 31' of the coding elements 10, 10' are disposed offset with respect to one another in the direction of movement, so that they can engage in the receiving space 51, 51' of the opposing modular part 50, 50'. In the situation according to FIGS. 10*c* and 10*d* the two coding elements 10, 10' are located in different positions. The projections 31, 31' are disposed opposite one another and abut one another, so that the modular parts 50, 50' cannot be joined together.

Depending upon the application several pairs of coding elements 10, 10' may be provided. In general with N pairs of coding elements 10, 10' (N=1, 2, 3, . . . ) a maximum of $2^N$ pairs of modular parts of a first and second type can be coded unambiguously, i.e. the coding can be set so that each of the $2^{N-1}$ modular parts of the first type can only be joined together with one single modular part of the second type.

FIG. 11 shows an example of an application of the coding elements 10, 10' in a device comprising the modular parts 60 and 60'. These can be joined together so that an electrical connection takes place between them. For this purpose the modular part 60' has an extension 67' which can be inserted into a recess 67 on the modular part 60, in which a contacting means (not visible here), for example a plate, is disposed, which can be electrically contacted with the modular part 60'. The modular part 60 is for example a component of a module which is designed for receiving, processing and emitting signals. Such modules are used for example in rail vehicles, for example trains, for control and/or automation purposes, which for example comprise the following features: air conditioning, heating, ventilation, illumination control, door control, slide protection, driver's cab automation, antiskid systems, traction, remote maintenance, wet room control, visualization, vehicle control device, etc. However, the modular parts can also be used in other areas, in particular in industry.

The modular part 60 here has a recess 61 which is designed for installation on a rack. The modular part 60 comprises on the side connecting elements 68, by means of which an adjacent modular part can be connected, in order for example to enable the exchange and/or the relaying of signals. The connecting elements 68 may be designed for example as connectors, blades, sockets or in some other form, so that an electrical connection can be produced.

The modular part 60' here is designed as a terminal block to which wires can be connected. It has connecting recesses 61' into which the wire ends can be inserted.

Holding means are provided for holding together the modular parts 60 and 60' which have been joined together. These comprise the following elements:

- a bow 62 which is formed on the modular part 60 and in which a hook 62' formed on the modular part 60' can engage,
- a projection 63' which is formed on the modular part 60' and can engage under a holding edge 63 formed on the modular part 60, and
- a bow 64' which is formed on the modular part 60' and which can be latched on a counterpart 64 formed on the modular part 60.

Naturally, depending upon the application the holding means can also be designed differently to cause a holding together, wherein the holding means are preferably designed so that a releasable connection between the modular parts is produced.

The respective modular part 60, 60' has a plurality of coding elements 10 or 10' which in each case are disposed in a row. In the present example 5 pairs of coding elements 10, 10' are provided, so that a maximum of $5^2=32$ pairs of modular parts 60, 60' can be unambiguously coded. Depending upon the application, naturally this number of coding elements may also be different. The respective modular part 60, 60' has a housing wall in which the receiving spaces are formed to receive the coding elements 10, 10'.

When a plurality of modules are assembled which in each case consist of the modular parts 60 and 60', the user can adjust the coding elements 10 and 10' manually so that in each case only one modular part 60' can be joined together with another modular part 60. As a result it is possible to prevent an incorrect connection from taking place in error and for example causing defective operation.

The coding illustrated here can be used in a versatile manner in order to adjust modular parts which can be joined together so that incorrect connections are prevented. The modular parts are configured for example for controlling, regulating and/or monitoring specific operating procedures or operations.

The holding means, which form a holding appliance for holding one modular part on the other modular part, can be versatile in design, and may for example comprise snap-in and latching elements, screw connections, separate securing parts, etc.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An arrangement comprising:

at least one modular part of a first type, at least one modular part of a second type, an adjustable coding, which has coding settings, which allow or prevent a joining together of the modular parts of the first and second type, and a holding appliance for holding one modular part on the other modular part when these are joined together, wherein the coding comprises coding elements arranged on the modular parts of the first and second type, each coding element being movably arranged in a receiving space formed in the modular part of the first or second type and comprising a projection projecting out of the receiving space, wherein the respective coding element is disposed so as to be as a whole linearly movable to and fro in a direction of movement in order to assume at least two coding positions, which are selectable so that a) for joining together of the modular parts of the first and second type, a respective projection of a coding element is disposed, offset, in the direction of movement with respect to the projection of an opposing coding element, and b) for prevention of a joining together of the modular parts of the first and second type, at least one projection of a coding element abuts the projection of an opposing coding element.

2. The arrangement according to claim 1, further comprising a locking mechanism for locking a coding element in the respective coding position.

3. The arrangement according to claim 2, wherein the locking mechanism comprises straight locking ridges, which extend transversally to an extension direction of the projection and are formed on the coding elements.

4. The arrangement according to claim 3, wherein the locking ridges are resiliently movable.

5. The arrangement according to claim 3, wherein each coding element comprises a wall, which includes weakened areas adjacent to the locking ridges.

6. The arrangement according to claim 3, wherein the respective locking ridge comprises a round head when viewed in cross-section.

7. The arrangement according to claims 3, wherein the receiving spaces comprise straight locking grooves in which the locking ridges are engageable.

8. The arrangement according to claim 1, wherein in the respective receiving space, a straight guide groove is formed, in which a guide part formed on the coding element engages.

9. The arrangement according to claim 8, wherein a guide element is disposed on a base of a respective receiving space in order to form the guide groove.

10. The arrangement according to claim 9, wherein the guide element is designed as a ramp.

11. The arrangement according to claim 1, wherein the respective receiving space is configured to be laterally open, so that for assembly a coding element is insertable into the receiving space transversally to an extension direction of the projection.

12. The arrangement according to claim 1, wherein the coding elements or the modular part of the first type are disposed in a first row and the coding elements on the modular part of the second type are disposed in a second row.

13. The arrangement according to claim 12, wherein the first row and the second row extend in the direction of movement of the coding elements, the projections of the coding elements in the first row and the projections of the coding elements in the second row having the same orientation.

14. The arrangement according to claim 1, wherein the modular parts of the first and second type are designed to produce an electrical connection therebetween when they are joined together.

15. The arrangement according to claim 1, wherein the modular part of the first type comprises a recess for mounting on a rack.

16. The arrangement according to claim 1, wherein the modular part of the first type comprises connecting elements for producing an electrical connection with a module mounted on a rack.

17. The arrangement according to claim 1, wherein the modular part of the second type comprises connections to which wires leading outwards are connectable.

18. The arrangement according to claim 1, wherein the modular part of the second type comprises a terminal block.

19. The arrangement according to claim 1, wherein N pairs of coding elements and at most $2^N$ pairs of modular parts of the first and second type are provided.

20. The arrangement according to claim 1, wherein the coding elements are configured to be manually movable to and fro in the direction of movement.

* * * * *